United States Patent [19]

Baker

[11] 4,018,405

[45] Apr. 19, 1977

[54] VEHICLE GUIDANCE CONTROL LINK UTILIZING LIGHT BEAM

[75] Inventor: William Gene Baker, Rolling Hills Estates, Calif.

[73] Assignee: Northrop Corporation, Los Angeles, Calif.

[22] Filed: Oct. 18, 1974

[21] Appl. No.: 516,082

[52] U.S. Cl. ..... 244/3.14; 244/3.17

[51] Int. Cl.[2] ..... F41G 7/00; F41G 9/00; F42B 15/02

[58] Field of Search ..... 244/3.13, 3.14, 3.16; 356/5

[56] References Cited

UNITED STATES PATENTS

| | | | |
|---|---|---|---|
| 3,415,465 | 12/1968 | Bedford | 244/3.14 |
| 3,484,167 | 12/1969 | Burns, Jr. | 356/5 |
| 3,698,811 | 10/1972 | Weil | 356/5 |
| 3,729,151 | 4/1973 | Hecker | 244/3.14 |
| 3,778,007 | 12/1973 | Kearney et al. | 244/3.14 |
| 3,848,830 | 11/1974 | Born | 244/3.16 |
| 3,856,237 | 12/1974 | Torian et al. | 244/3.14 |

*Primary Examiner*—Samuel W. Engle
*Assistant Examiner*—Thomas H. Webb
*Attorney, Agent, or Firm*—Edward A. Sokolski

[57] ABSTRACT

An electromagnetic beam which is preferably generated by means of a laser is transmitted to a vehicle such as a missile to be controlled, and reflected back from such vehicle by means of an optical reflector. The beam is passed through separate optical modulators, one of these being at the control station, where the transmitter is located; the other of these being on the controlled vehicle. A television type camera is installed on the vehicle and provides a picture of objects in the path of the vehicle. This picture is modulated onto the beam by means of the aforementioned modulator. The picture is received at the control station and fed to a display device for viewing by an operator. Using this picture, the operator moves a hand control device in azimuth and elevation, as may be necessary, to generate control signals to correct the path of the vehicle so as to properly direct its course towards a selected target. The control signals so generated are modulated onto the beam and received at the vehicle where they are decoded and utilized to control the steering of the vehicle.

8 Claims, 7 Drawing Figures

VEHICLE GUIDANCE CONTROL LINK UTILIZING LIGHT BEAM

This invention relates to the guidance of vehicles from a remote station by means of signals transmitted on an optical beam, and more particularly to such a system which utilizes a TV type picture in implementing the desired control.

Control systems for controlling the flight of a vehicle such as a missile from a remotely located station, wherein a television picture provides a forward view ahead of the missile, have been in use for some time. A device of this type is described, for example, in U.S. Pat. No. 2,616,031 to Nosker. In prior art systems of this type, a transmitter is provided on the vehicle which transmits the television picture to the ground station where this picture is used to generate a control signal. This control signal is transmitted by means of a transmitter at the ground station to the vehicle for use in correcting the course of the vehicle as may be necessary. This type of system thus requires a transmitter both at the ground station and on the vehicle.

In recent years, optical beams such as provided by a laser have found widespread uses in communication applications. Where a line of sight is available, this type of communications carrier has distinct advantages over radio links in that it tends to be less susceptible to counter measures.

The system of the present invention affords distinct advantages over control links of the prior art for the particular applications indicated above by eliminating the need for a transmitter on the vehicle, and rather providing means for utilizing a beam transmitted from the ground and reflected back from the vehicle for carrying the two-way information needed to implement vehicle control. Further, the system of the present invention utilizes an optical beam, which may be generated by means of a laser, for the information carrier, this beam being modulated with signals for steering the vehicle by means of an optical modulator located at the control station. The beam is modulated by means of a second optical modulator located at the vehicle, with signals from a TV camera to provide a view ahead of the vehicle, this beam being reflected back to the control station.

The system of the invention will now be described in connection with the accompanying drawings, of which:

Briefly described, the system of the invention is as follows: A beam of electromagnetic energy, preferably a light beam which may be provided by a laser is generated at a control station. This beam is modulated by means of an optical modulator which may comprise a Kerr cell or Pockels cell, with signals representing steering control to be provided for the vehicle. The modulated optical beam is directed toward the vehicle, whereat it is split, a portion thereof being fed to an optical receiver and a portion thereof being fed through an optical modulator of the same general type utilized at the control station. The receiver detects the signals and passes them on to a decoder which separates the sync signals for the television camera from the steering control signals. The steering control signals are fed to a steering controller where they are utilized to control the flight of the vehicle. The sync signals are used for the television camera. The picture from the camera is utilized as a modulation signal for the optical modulator, this picture being reflected back to the control station by means of an optical reflector, such as a suitable cube corner reflector. The reflected signals are received at the control station by means of an optical receiver which detects and amplifies the signals and feeds them to a display device, such as a television picture tube. The operator utilizes the television picture to manually generate the steering signals which, as already mentioned, are modulated onto the optical beam to control the flight of the vehicle as may be necessary.

Figure 1:
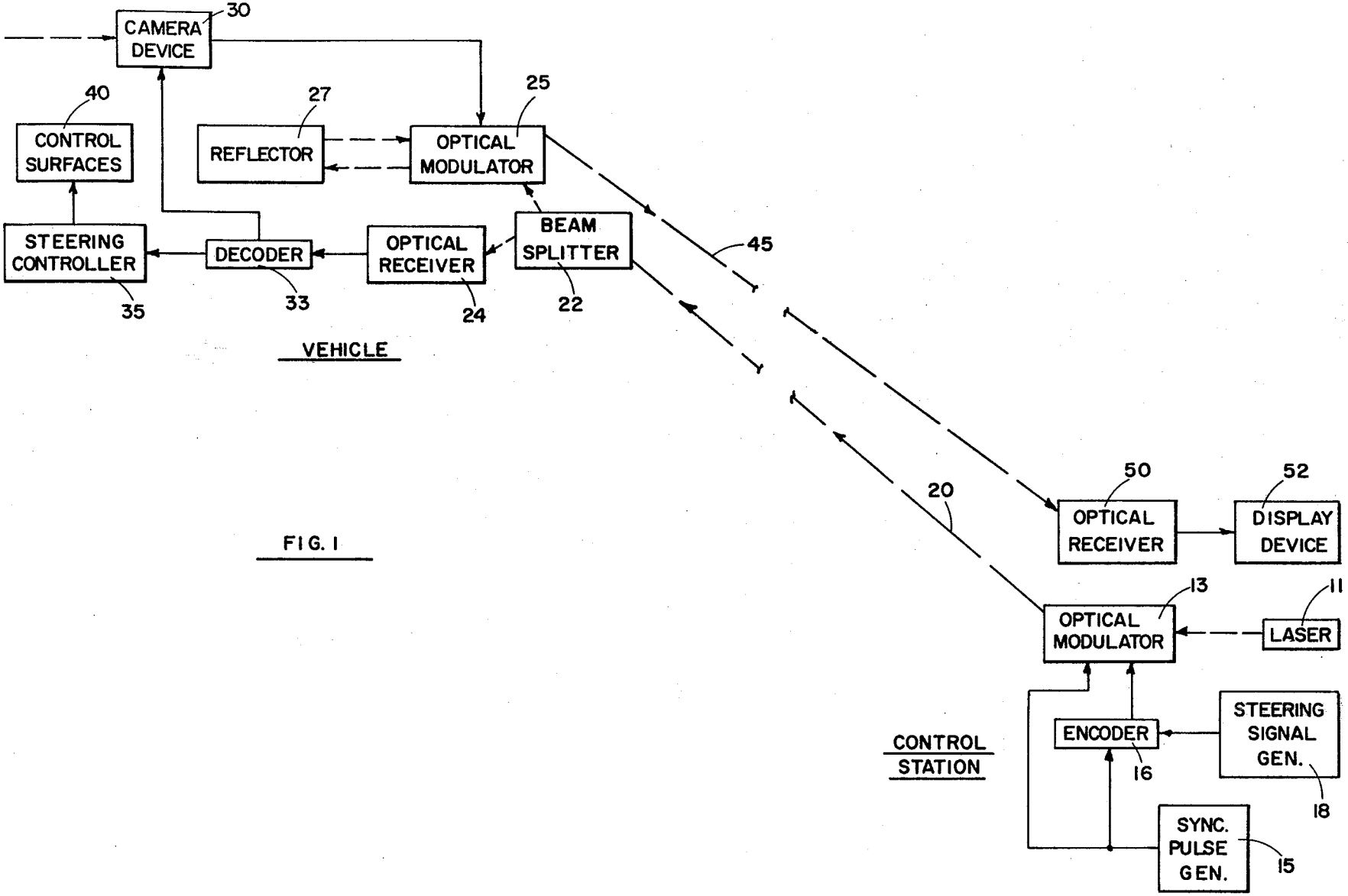
FIG. 1 is a functional schematic showing the basic operation of the system.

Referring now to FIG. 1, the general features of the system of the invention are schematically illustrated. A laser beam is generated by means of laser 11, this beam being directed through optical modulator 13 which may comprise one of such devices well known in the prior art, such as a Kerr cell or Pockels cell. Modulation signals are fed to optical modulator 13 from sync pulse generator 15 and encoder 16. Sync pulse generator 15, as to be described further on in the specification, comprises a conventional synchronization pulse generator for generating television synchronization signals. Encoder 16 receives steering control signals from steering signal generator 18 and encodes these signals digitally, as to be explained further on in the specification in connection with FIG. 4.

Modulated beam 20 is transmitted from the control station to the vehicle, where the beam is split by means of optical beam splitter 22. Signals from the beam splitter are fed to optical receiver 24 and optical modulator 25. The signals from the beam splitter are passed through optical modulator 25 and reflected back therethrough by means of reflector 27 which may comprise a cube corner reflector. Optical modulator 25 is modulated by the output of camera device 30 which provides a television picture of the view in the direction of travel of the vehicle.

Optical receiver 24 detects the signals received at the vehicle from the control station, these detected signals being fed to decoder 33 which separates the television synchronization signals and steering control signals, the synchronization signals being fed to camera device 30 for use in synchronizing the operation thereof, i.e., in providing horizontal and vertical sync. Decoder 33 also provides steering control signals as generated at the control station for steering controller 35. Steering controller 35 controls the control surfaces 40 of the vehicle in response to the steering control signals received thereby from decoder 33.

The picture signals modulated onto the beam by means of optical modulator 25 are transmitted on return beam 45 back to the control station where they are received by optical receiver 50. The television picture signals received by receiver 50 are fed to display device 52 which may comprise a conventional television picture tube. The pictures on display device 52 are employed by the operator in operating a manual "stick" to generate steering control signals by means of steering signal generator 18, these signals, as already noted, being transmitted to the vehicle to control the course thereof.

Figure 2:
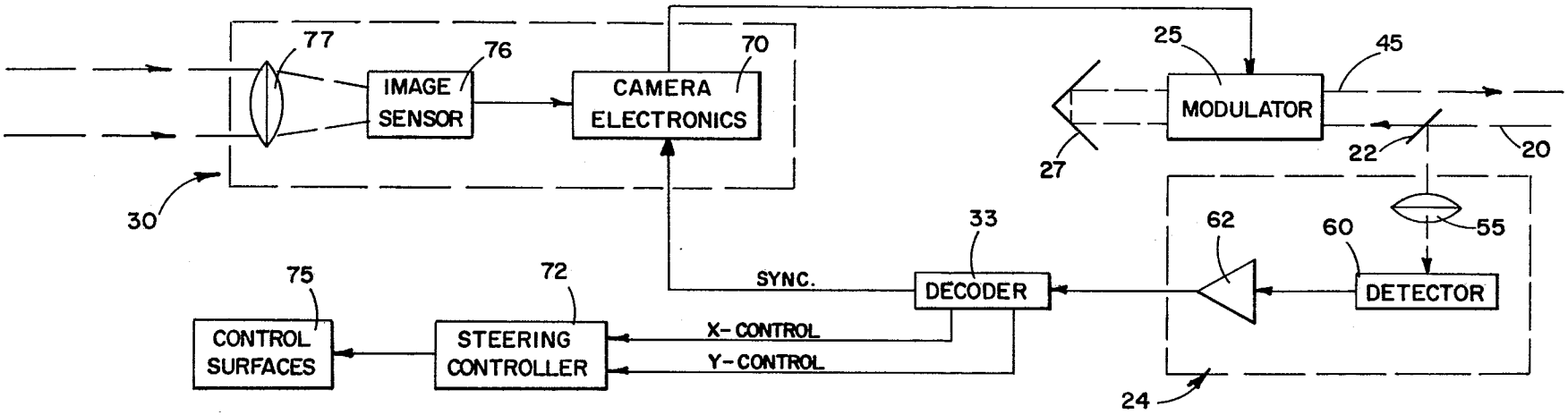
FIG. 2 is a functional schematic showing one embodiment of the equipment aboard the vehicle for implementing the system of the invention.

Referring now to FIG. 2, a preferred embodiment of equipment for implementing the control functions on the vehicle is schematically illustrated. The beam 20 transmitted from the control station is split by means of beam splitter 22, a portion of the signal being directed through lens 55 to optical detector 60. Detector 60, which may comprise a silicon photodetector, has its output fed to amplifier 62, the output of amplifier 62 being fed to decoder 33. Decoder 33 separates the television sync signals from the steering control signals, and further, converts the steering signals from serial to parallel form. The television synchronization signals are fed from the decoder to camera electronics 70. The steering control signals are fed from the decoder as azimuth (X) and elevation (Y) signals to steering controller 72. The control signals are utilized by steering controller 72 to control the control surfaces 75 of the vehicle.

Objects in the direct path of the vehicle are sensed by image sensor 76 which operates in conjunction with lens 77. Image sensor 76 may comprise a charged coupled detector TV camera which utilizes an array of silicon diodes. The output of image sensor 76 is fed to camera electronics 70 which forms the composite TV signal in conjunction with the synchronization signals received from decoder 33. The composite TV signal is fed from camera electronics 70 to modulator 25, as already noted.

Figure 3:
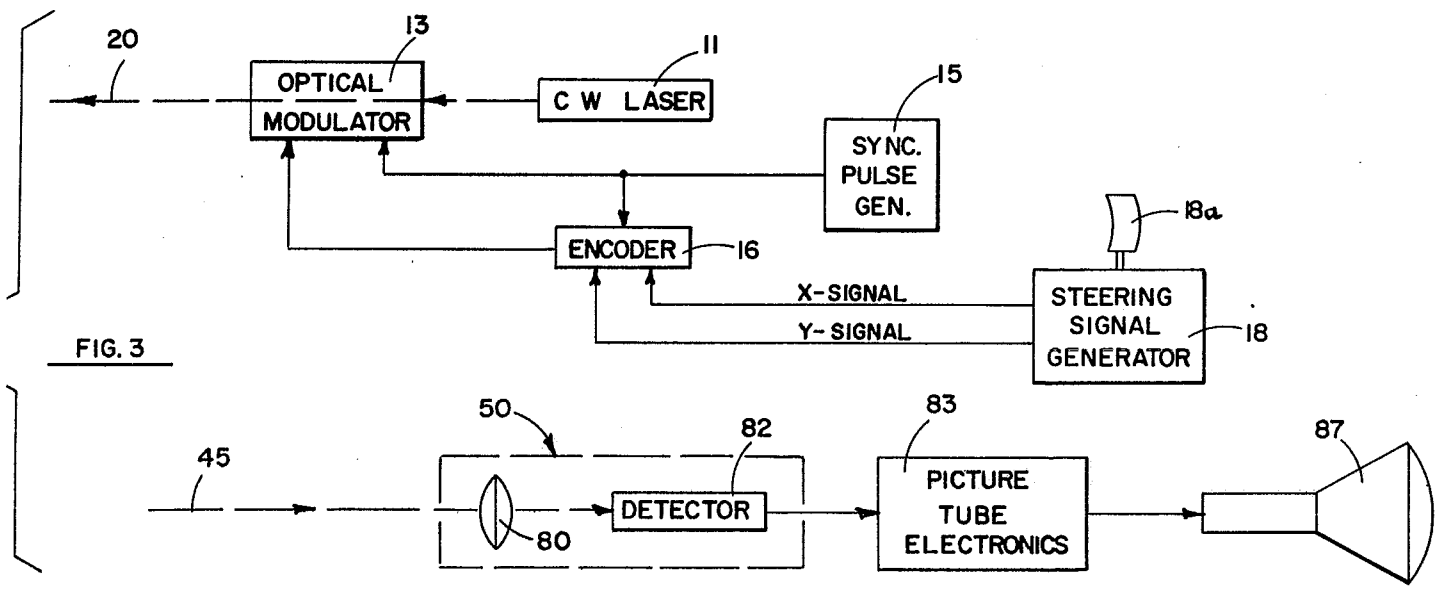
FIG. 3 is a schematic diagram showing one embodiment of the equipment at the control station for implementing the system of the invention.

Referring now to FIG. 3, a preferred embodiment of equipment that may be utilized to implement the functions at the control station is schematically illustrated. A laser beam is generated by means of CW Laser 11, this signal being passed through optical modulator 13 which, as already noted, may comprise a Kerr cell or Pockels cell. Azimuth (X) and elevation (Y) signals are generated by means of steering signal generator 18 which includes a stick 18*a* which may be manipulated by the operator, and electrical circuitry (to be described further on in the specification) for converting the mechanical motion of stick 18*a* into electrical signals. These electrical signals are fed to encoder 16. Television synchronization pulses are generated by means of sync pulse generator 15, these signals being utilized to synchronize the operation of encoder 16, and also being fed to optical modulator 13 as a modulation signal therefor. The output of encoder 16 which includes steering control signals in digitally encoded form, is also used as a modulation signal for the optical modulator.

Signals received at the ground station on the reflected beam 45 are directed by means of lens 80 onto detector 82. Detector 82 may comprise a silicon photo detector and the output thereof is fed to picture tube electronics 84 which may include amplifiers, sync circuits and the other necessary circuitry for operating television picture tube 87.

Figure 4:
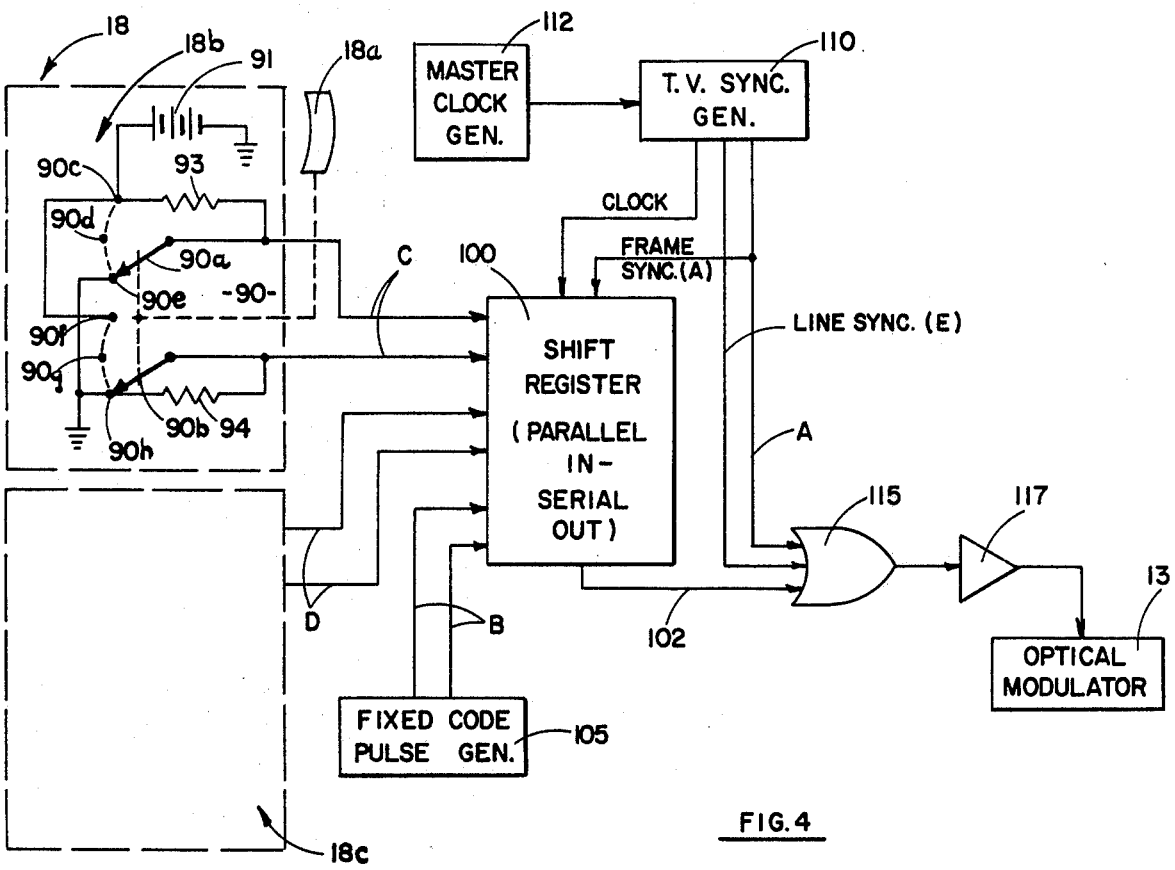
FIG. 4 is a schematic diagram showing one embodiment of an encoder which may be utilized at the ground station in the system of the invention.

Referring now to FIG. 4, one embodiment of an encoder which may be utilized at the ground station is schematically illustrated. Steering signal generator 18 includes circuitry 18*b* for generating azimuth control signals, and circuitry 18*c* for generating elevation control signals. The details of only the azimuth control circuit 18*b* are shown, in view of the fact that the elevation control circuit 18*c* is identical in configuration. Selector switch 90 has a pair of contact arms 90*a* and 90*b* which are mechanically coupled to control stick 18*a* which is manipulated by an operator to alternatively contact one of switch contacts 90*c*, *d*, or *e*, (in the case of switch arm 90*a*) and *f*, *g*, or *h*, (in the case of switch arm 90*b*). Switch arms 90*a* and 90*b* are connected to provide separate inputs, C, to shift register 100. Switch arm 90*a* is connected through resistor 93 to the positive terminal of DC power source 91, while switch arm 90*b* is connected through resistor 94 to ground.

Switch arms 90*a* and 90*b* are ganged together and are moved from contact to contact by means of control stick 18*a*. When arms 90*a* and 90*b* are positioned as indicated in FIG. 4 in contact with switch contacts 90*e* and 90*h* respectively, a 0 signal is provided on both of lines C to shift register 100. Shift register 100 receives parallel inputs and provides serial outputs on line 102 of the signals received thereby. With switch contacts 90*a* and 90*b* connected as illustrated in FIG. 4, the C inputs to the shift register will produce two zero outputs in sequence as indicated at C in FIG. 5A. With switch contacts 90*a* and 90*b* connected to switch contacts 90*d* and 90*g* respectively, the inputs C to the shift register will be a 1, 0 resulting in a similar sequential output on line 102, while with switch contacts 90*a* and 90*b* connected to contact terminals 90*c* and 90*f*, respectively, 1, 1 C control will be fed into and out of the register. Thus, it can be seen that different coded outputs are provided which can serve to represent a "left" control signal, a 0 control signal, and a "right" control signal, these signals being provided in binary code.

Similarly, elevation control signals "D" are provided to the shift register from control circuit 18*c* to provide elevation control signals in proper sequence on line 102. For exemplary purposes, a binary 1, 1 control signal D is shown in FIG. 5A.

To assure proper identification of the coded control signals, i.e., to avoid their production by extraneous signals, a fixed coded signal "B" is provided to the shift register from fixed code pulse generator 105. This signal is shown as a 1, 1, binary signal in FIG. 5A, as it appears in the output of the shift register on line 102.

TV synchronization signals are provided by TV sync generator 110, which may comprise a conventional off-the-shelf integrated circuit unit. TV sync generator is driven by clock pulses from master clock generator 112, and has in its output a clock pulse signal synchronized with the output of clock generator 112 and television line sync pulses, "E", and frame sync pulses, "A" (as shown in FIG. 5A). The serial outputs on line 102 as well as the line and frame sync signals from sync generator 110 are fed to OR gate 115 and thence through amplifier 117 to optical modulator 13. Serial readout of the information stored in the shift register is provided at the clock frequency, such serial readout being initiated by the trailing edge of the frame sync pulse which is provided to the register. In this manner, control signals such as those illustrated in FIG. 5A are provided for steering control and these signals are multiplexed with the TV sync signals and modulated on the laser beam by means of optical modulator 13.

Figure 5A:
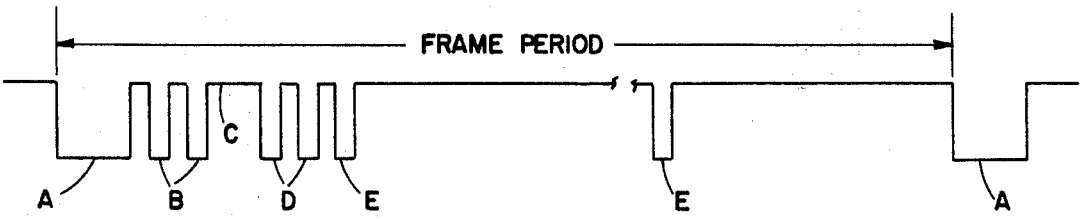
FIGS. 5A and 5B illustrate typical wave forms which may be transmitted from the control station and returned from the vehicle respectively in the system of the invention.
Figure 5B:
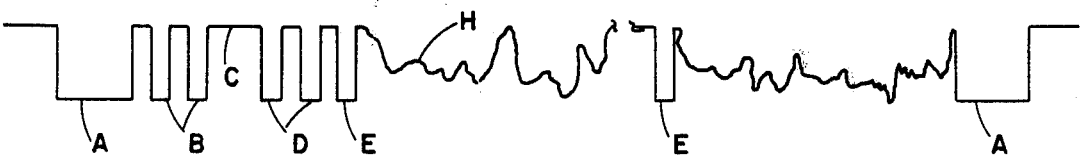

Referring now to FIG. 5B, signals received at the vehicle for the transmitted signals of FIG. 5A are shown. It is to be noted that these signals are identical to the transmitted signals except for the fact that the television video "H" has been added thereto for display on the TV picture tube (display device 52, FIG. 1).

Figure 6:
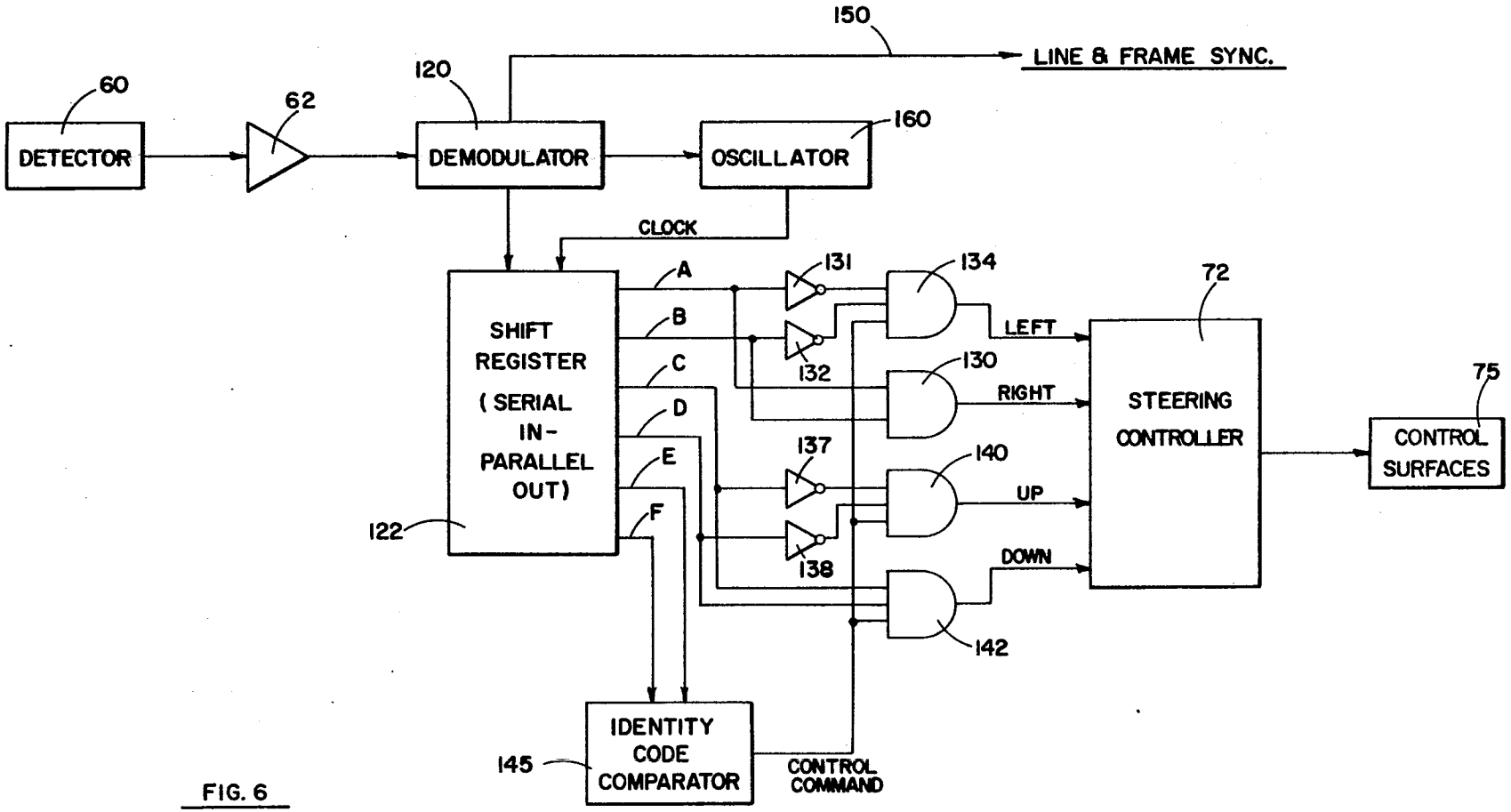
FIG. 6 is a schematic drawing illustrating one embodiment of decoding circuitry which may be utilized at the vehicle in the system of the invention.

Referring now to FIG. 6, decoding circuitry which may be utilized at the vehicle in the system of the invention is schematically illustrated. The output of optical detector 60 is amplified by means of amplifier 62 and fed to demodulator 120. The demodulated output signal which is fed from demodulator 120 to shift register 122 corresponds to the signal modulated on the beam at the ground station (shown in FIG. 5A). Shift register 122 operates to convert the serial input signals to parallel output signals, these signals appearing in parallel on lines A–F of the register. The signals on lines A and B represent azimuth control. These outputs are fed directly to AND gate 130 and through inverting amplifiers 131 and 132 to AND gate 134. Similarly, elevation control signals are fed on Lines C and D through inverting amplifiers 137 and 138 to AND gate 140 and directly to AND gate 142. The identity code outputs are fed on Lines E and F of the register to identity code comparator 145 which in response to the arrival of the proper identity code provides a control command signal to each of AND gates 134, 130, 140 and 142. The operation of shift register 122 is synchronized by means of clock pulses fed thereto from oscillator 160 which is synchronously operated in response to line sync signals received from demodulator 120. Line and frame sync signals for the TV camera are fed out from demodulator 120 on line 150.

The output of AND gates 134, 130, 140 and 142 are fed to steering controller 72 for use in controlling control surfaces 75. It should be apparent from the logical control circuitry, that a left control signal can be provided to the controller with 0 signals on both lines A and B of the shift register, while right control signals can be provided with 1 signals on both of these lines. Similarly, an "up" control signal can be provided with 0 signals on both lines C and D, while a "down" signal can be provided with 1 outputs on both of these lines. It also should be apparent that with a 1 signal on each of the paired lines and a 0 signal on the other of such lines, that no control signal will pass through the gates to the controller.

While the system of the invention has been described and illustrated in detail, it is to be clearly understood that this is intended by way of illustration and example only and is not to be taken by way of limitation, the spirit and scope of the invention being limited only by the terms of the following claims.

I claim:

1. A vehicle guidance control link for controlling the steering of a vehicle from a remotely located control station comprising:

means at the control station for generating a laser beam, means for generating control signals for steering said vehicle, said last mentioned means including a manually operable control, means for modulating said beam with said control signals, said beam being directed towards said vehicle, means on the vehicle for receiving said beam and including means for splitting the beam into first and second portions, means for demodulating the control signals from said second beam portion, means responsive to said control signals for steering the vehicle, means for generating a video signal indicating objects in the path of the vehicle, means for modulating the first beam portion with said last mentioned signal, means for reflecting the first beam portion back to said control station, means at said control station for receiving said reflected beam and including means for demodulating said video signal therefrom, and display means for providing a visual display of said video signal, whereby an operator by observing said display is enabled to manipulate said manually operable control to determine said control signals.

2. The control link of claim 1 and additionally including means for encoding said control signals in digital binary code.

3. The control link of claim 3 wherein said means responsive to said control signals comprises a digital decoder for decoding the binary coded signals and a steering controller for controlling the vehicle in response to the decoded signals.

4. The control link of claim 1 wherein said display means comprises a television picture tube.

5. In a vehicle guidance control link for controlling the maneuvering of a vehicle from a remotely located control station, means for generating a light beam, means for generating control signals for maneuvering the vehicle, said last mentioned means including a manually operable control, optical modulator means for modulating the beam with said control signals, said beam being directed towards said vehicle, means on said vehicle for receiving said beam and including means for splitting the beam into first and second components, a television camera on said vehicle, said camera being positioned to provide a video output representing objects in the forward path of the vehicle, optical modulator means for modulating said first beam component with the video output of said camera, optical reflector means for reflecting said first beam component back to the control station, means for demodulating the control signals from the second component of the beam, means responsive to the demodulated control signals for controlling the maneuvering of the vehicle, receiver means at said control station for receiving the beam component reflected from the vehicle and including means for demodulating the camera video output therefrom, and television picture tube means responsive to the video output of said receiver means for providing a picture corresponding to the camera output, whereby an operator by observing the picture on said tube is enabled to manipulate the manually operable control to determine said control signals.

6. The guidance control link of claim 5 wherein said means for generating a light beam comprises a laser.

7. The guidance control link of claim 5 and additionally including means at said control station for encoding the control signals in digital binary form and means on said vehicle for decoding the binary coded control signals.

8. The control link of claim 5 wherein said optical reflector means comprises a cube corner reflector.

* * * * *